US008468758B2

(12) United States Patent
Jenkins et al.

(10) Patent No.: US 8,468,758 B2
(45) Date of Patent: Jun. 25, 2013

(54) SUPPORT FRAME FOR SLIDING DOOR

(75) Inventors: Steve Jenkins, Hertfordshire (GB); Nick Gadsby, Hertfordshire (GB)

(73) Assignee: Royde & Tucker Limited, Hertfordshire (GB)

( * ) Notice: Subject to any disclaimer, the term of this patent is extended or adjusted under 35 U.S.C. 154(b) by 0 days.

(21) Appl. No.: 12/739,181

(22) PCT Filed: Jul. 31, 2008

(86) PCT No.: PCT/EP2008/060059

§ 371 (c)(1),
(2), (4) Date: Apr. 22, 2010

(87) PCT Pub. No.: WO2009/059820

PCT Pub. Date: May 14, 2009

(65) Prior Publication Data

US 2010/0307077 A1 Dec. 9, 2010

(30) Foreign Application Priority Data

Nov. 7, 2007 (GB) ..... 0721836.5

(51) Int. Cl.
*E04B 1/04* (2006.01)

(52) U.S. Cl.
USPC ..... 52/207; 52/210; 52/217

(58) Field of Classification Search
USPC ..... 52/217, 207, 210, 243.1, 167.1, 479, 52/204.1, 588.1, 573.1, 36.1, 205, 481.1, 52/656.7
See application file for complete search history.

(56) References Cited

U.S. PATENT DOCUMENTS

| | | | | |
|---|---|---|---|---|
| 881,061 | A | 3/1908 | Devlin | |
| 1,562,055 | A | 11/1925 | Richards | |
| 2,991,855 | A * | 7/1961 | Buell et al. | 52/481.1 |
| 3,451,153 | A | 6/1969 | Dohanyos | |
| 3,812,621 | A * | 5/1974 | Ragland | 49/505 |
| 4,077,160 | A | 3/1978 | Stewart | |
| 4,319,431 | A * | 3/1982 | Siers | 49/426 |
| 4,709,517 | A | 12/1987 | Mitchell et al. | |
| 4,825,610 | A * | 5/1989 | Gasteiger | 52/217 |

(Continued)

FOREIGN PATENT DOCUMENTS

| | | |
|---|---|---|
| CA | 1330501 C | 7/1994 |
| GB | 469098 | 7/1937 |
| GB | 2 135 363 A | 11/1976 |

OTHER PUBLICATIONS

International Search Report and Written Opinion for International Application No. PCT/EP2008/060059, dated Nov. 26, 2008; 10 pages.
Australian Examination Report corresponding to Australian Patent Application No. 2008324399, dated Mar. 17, 2011; 2 pages.

(Continued)

*Primary Examiner* — Brian Glessner
*Assistant Examiner* — Brian D Mattei
(74) *Attorney, Agent, or Firm* — Carter, DeLuca, Farrell & Schmidt, LLP

(57) ABSTRACT

A support frame for a sliding door comprising upper and lower support members, and a side panel attachable so as to extend between said upper and lower support members, wherein the side panel comprises two panel portions that slide relative to each other and overlap to enable the distance between the upper and lower support members to be altered during installation of the support frame.

13 Claims, 8 Drawing Sheets

U.S. PATENT DOCUMENTS

| | | | | |
|---|---|---|---|---|
| 4,915,345 | A * | 4/1990 | Lehmann | 249/18 |
| 5,172,527 | A * | 12/1992 | Ault | 52/145 |
| 5,735,100 | A * | 4/1998 | Campbell | 52/645 |
| 6,094,877 | A * | 8/2000 | White | 52/247 |
| 6,209,273 | B1 * | 4/2001 | Jeffers et al. | 52/220.7 |
| 7,814,721 | B2 * | 10/2010 | Raineri | 52/537 |
| 2006/0053693 | A1 * | 3/2006 | Sullivan | 49/168 |

OTHER PUBLICATIONS

Australian Examination Report corresponding to Australian Patent Application No. 2008324399, dated Dec. 20, 2011; 2 pages.

European Examination Report corresponding to European Patent Application No. GB0721836.5, dated Jan. 11, 2012; 2 pages.

* cited by examiner

SUPPORT FRAME FOR SLIDING DOOR

CROSS-REFERENCE TO RELATED APPLICATIONS

The present application is a 35 U.S.C §371 National Phase Filing claiming the benefit of and priority to International Application No. PCT/EP2008/060059, filed on Jul. 31, 2008, which claims the benefit of and priority to British (GB) Patent Application No. 0721836.5, filed on Nov. 7, 2007, the entire contents of each of which are incorporated herein by reference.

The present invention relates to a support frame for mounting a sliding door. In particular, the invention relates to a support frame for mounting a sliding door in a cavity of a partition wall.

Sliding doors are well known for enclosing a doorway formed in a wall or the like. Such doors are generally mounted by means of a sliding guide mechanism fitted to the upper and/or lower ends of a door which is received in a respective guide rail which forms a track along which the door slides. Traditionally, such tracks have extended parallel to a portion of the wall adjacent to the doorway and across the doorway such that the door can slide from an 'open' position, wherein the door locates along the wall, and a 'closed' position, wherein the door locates to cover the doorway. An advantage of such a door is that it reduces the floor space required to open and close the door. However, a problem with such a door is that, generally, it does not form a close fit with the doorway and so allows air draughts and sound to pass through the space formed therearound. Further, the door lies along the outer surface of the respective wall when it is 'open' such that furniture or the like cannot be located thereagainst.

The interior walls of modern buildings, such as residential houses, are generally formed from partition or stud walls. Such a partition wall is formed from a framework, generally of timber construction, extending between a ceiling, a floor and opposing walls to partition the interior space into separate rooms. Plasterboard is mounted to either side of the framework to enclose the framework therebetween and form a planar surface. With such an arrangement it will be understood that a cavity is formed internally within the walls between the opposing panels of plasterboard. Additionally, doorways are formed through the partition wall, by forming a necessary sized space in the framework which is then left uncovered by plasterboard.

Therefore, it is known to mount a sliding door within the internal cavity formed between opposing plasterboard panels. However, with such an arrangement, it is necessary to remove part of the framework of the wall to create a substantially sized space to receive a sliding door when it is in an 'open' position. Therefore, there is a problem in that it is necessary to provide a support frame to support the plasterboard and form part of the framework of the wall itself, as well as to support the guide tracks along which the door is guided as well as the door itself.

The space between the opposing plasterboard surfaces or the like is minimised so as to maximise the floor space of the adjoining rooms and so it is advantageous to minimise the size of the support frame itself.

Support frames are known which are generally formed from planar sheets of material, in particular steel, which extend between lower and upper support members to support the upper and lower support members and form a surface and to which plasterboard panels or the like may be mounted. A disadvantage of such an arrangement is that the planar sheets of material are not particularly rigid and so must be of a substantial thickness to reduce deflection and form a support frame. Additionally, buildings are not generally built to exact tolerances and so it is necessary to alter the size of the frame, and hence the panel. With conventional systems it is necessary to take precise measurements so that the frame can be made to measure. Alternatively, the components can be provided oversized and then cut to the desired measurement prior to installation. However, this necessitates the use of metal cutting implements such as an angle grinder and metal saws which an installer may not have readily available.

The present invention seeks to provide a support frame for mounting a sliding door that overcomes or substantially alleviates the problems with conventional systems referred to above.

SUMMARY

According to the present invention, there is provided a support frame for a sliding door comprising upper and lower support members, and a side panel attachable so as to extend between said upper and lower support members, wherein the side panel comprises two panel portions that slide relative to each other and overlap to enable the distance between the upper and lower support members to be altered during installation of the support frame.

Preferably, the panel portions have corrugations configured such that, when the panel portions overlap, the corrugations interlock to prevent movement of the panels relative to each other, other than sliding in a direction extending along the length of the corrugations.

Conveniently, the corrugations form a tenon and a corresponding mortise such that the corrugations on opposing panel portions interlock to form a dovetail joint.

The corrugations on each panel portion may form a plurality of tenons and mortises to interlock with a plurality of tenons and mortises formed on the opposing panel portion.

In one embodiment the support frame for a sliding door according comprises first and second panel portions, wherein the corrugations comprise a channel formed in the first portion of the side panel and a corresponding elongate ridge formed in the second portion of the side panel which is receivable in the channel such that the elongate ridge slides in the channel.

Preferably, the elongate ridge comprises a pair of side walls to locate in the channel, substantially parallel to a pair of side walls of the channel.

Advantageously, the elongate ridge interlocks with the channel, such that the first and second portions of the side panel are slidable relative to each other along a first direction only, but cannot be drawn away from each other in a second direction perpendicular to the first direction.

Preferably, the side walls of the channel converge towards a mouth of the channel and the side walls of the elongate ridge are correspondingly angled.

In a preferred embodiment, the elongate ridge is wedge-shaped for mounting in a correspondingly wedge-shaped channel so that a portion of the wedge-shaped elongate ridge dovetails with the channel and is slidable therein.

The support frame may further comprise a channel formed in the second portion of the side panel and a corresponding elongate ridge formed in the first portion.

Preferably, one side wall of the channel forms the side wall of an adjacent elongate ridge formed in each portion of the side panel.

The support frame may further comprise a plurality of alternating channels and elongate ridges formed in the first and second channels, each elongate ridge corresponding with a respective channel in the opposing portion of the side panel, wherein each elongate ridge is defined by adjacent channels in a side panel.

Preferably, the upper and lower support members are arcuately shaped and the first and second portions of the side panel are deformable to be fixedly mountable along the upper and lower support members respectively.

Conveniently, the support frame further comprises a plurality of corresponding first and second support portions fixedly mountable to the upper and lower support members respectively.

Preferably, a pair of side panels are attachable on opposing sides of said upper and lower support members so as to extend between said upper and lower support members.

DETAILED DESCRIPTION OF THE DRAWINGS

Embodiments of the present invention will now be described, by way of example only, with reference to the accompanying drawings, in which.

DETAILED DESCRIPTION OF EMBODIMENTS

Figure 1:
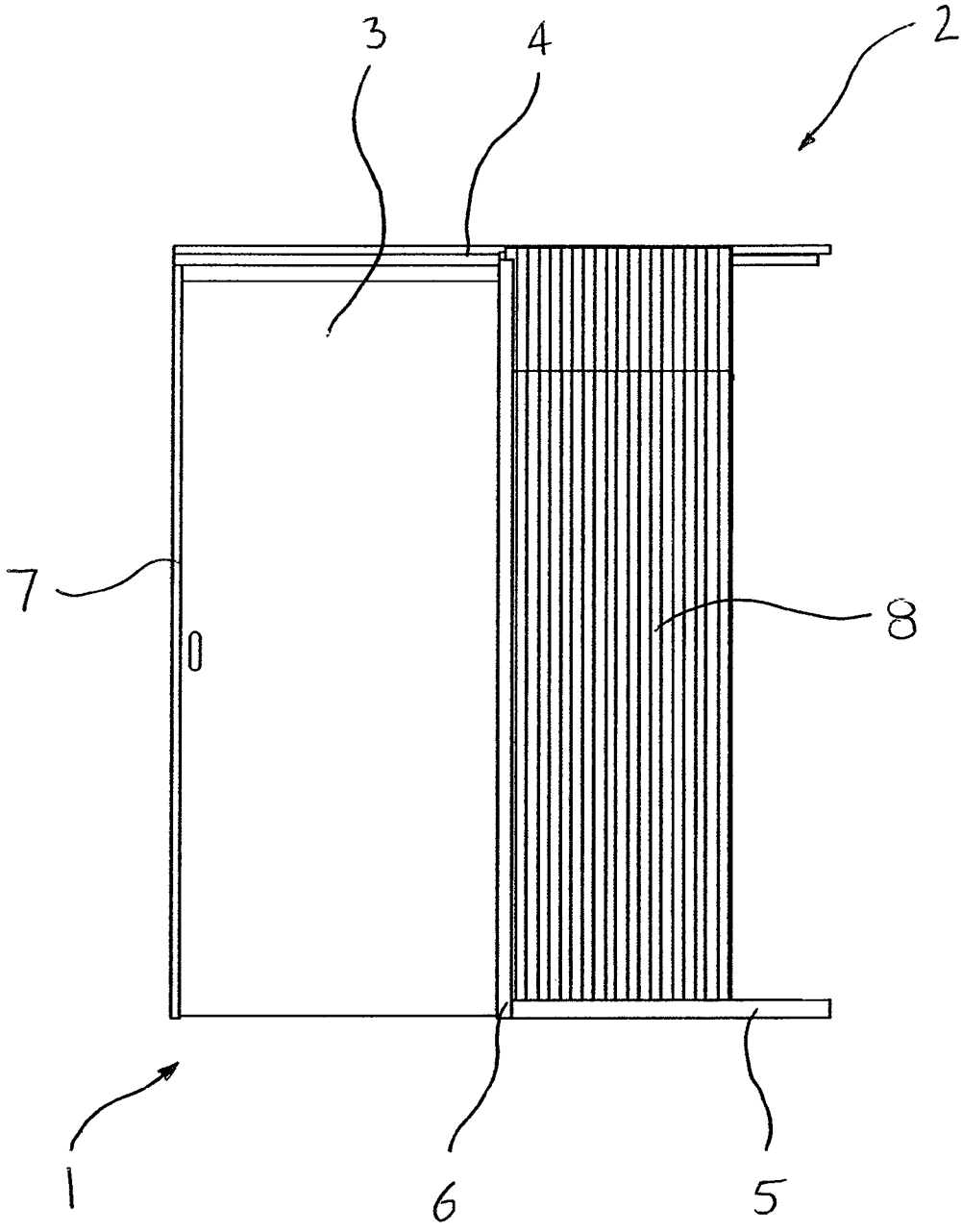
FIG. 1 is a side view of a support frame for a sliding door in accordance with the present invention.
Figure 2:
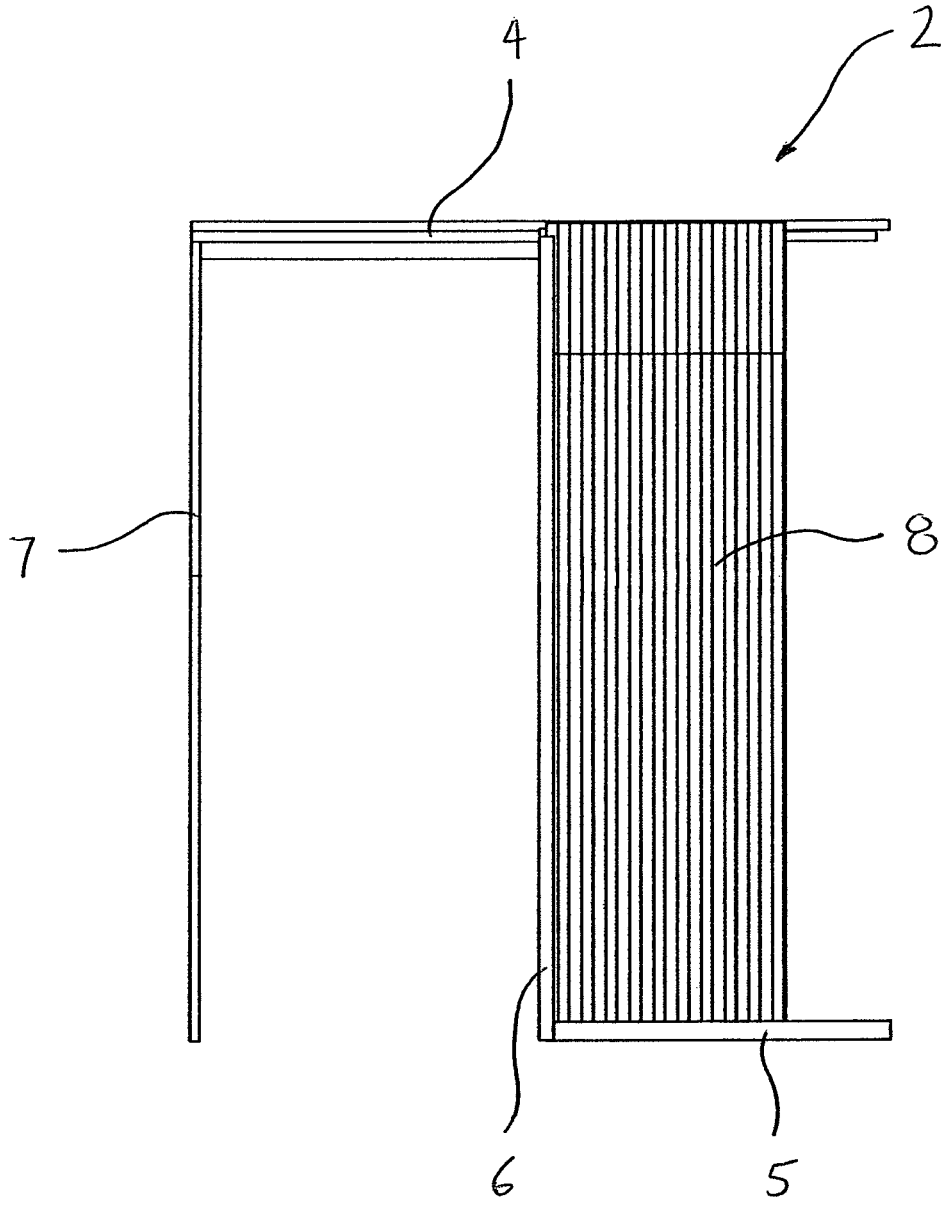
FIG. 2 is a side view of a support frame for a sliding door as shown in FIG. 1, showing a sliding door supported thereon in a 'closed' position.

Referring now to the drawings, there is shown in FIGS. 1 and 2 a sliding door assembly 1 comprising a support frame 2 and a sliding door 3. The support frame 2 includes an upper support arrangement 4, a sole plate 5, an end support 6, an end panel 7 and a pair of side panels 8. The sliding door 2 is slidably mounted to the upper support arrangement 4 in this exemplary embodiment, although it will be understood that the invention is not limited thereto and may be mounted to the sole plate 5.

Figure 3:
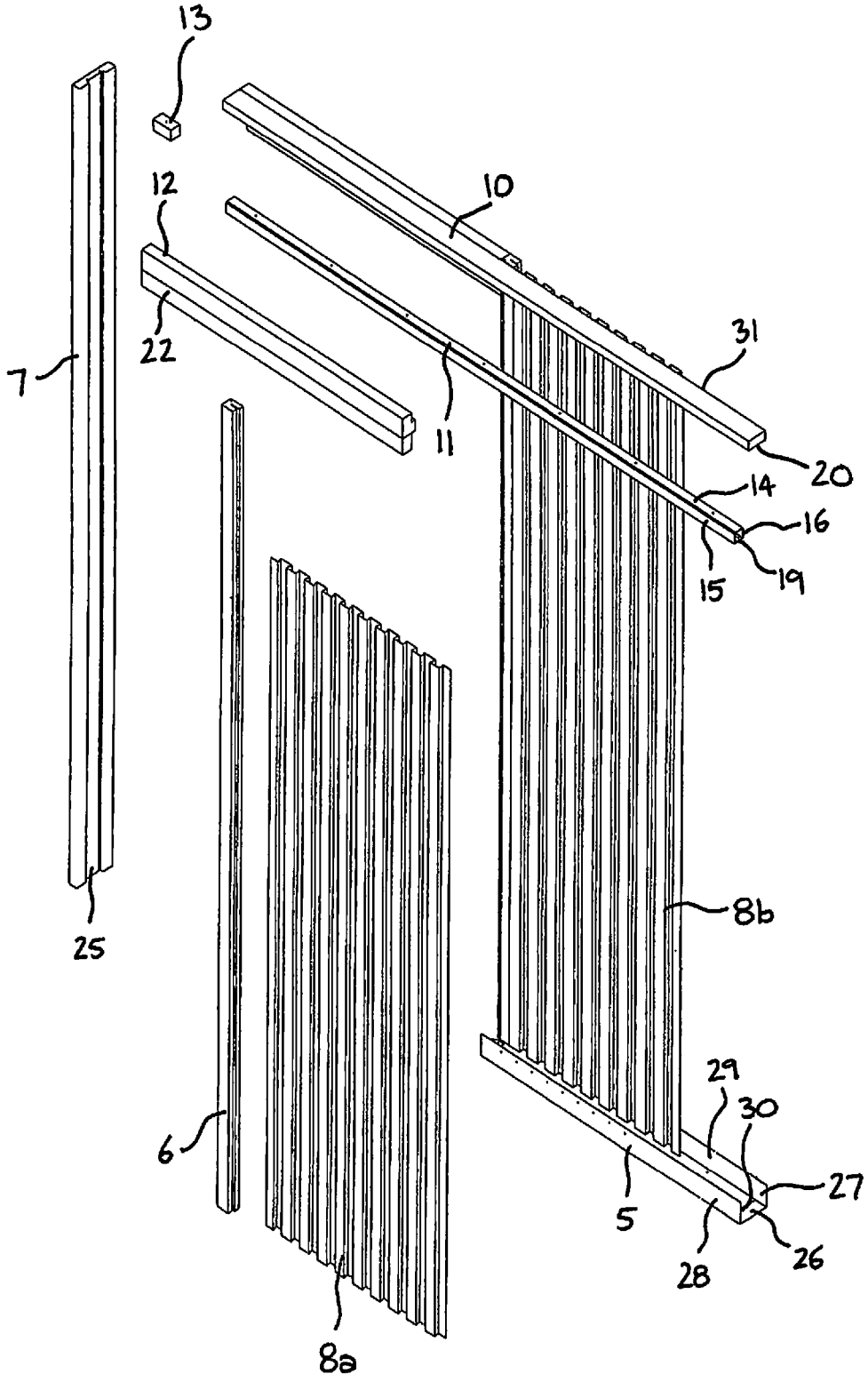
FIG. 3 is an exploded perspective view of the support frame for a sliding door as shown in FIG. 1.

Referring to FIG. 3, an exploded view of the support frame 2 is shown. The upper support arrangement 4 comprises an upper support member 10, a guide track 11, a door mounting 12 and an end stop 13. The upper support member 10 is a beam which is shown in the drawings to be solid, but may have a box-shaped cross section, and extends substantially horizontally. The guide track 11 has a substantially C-shaped cross section comprising a base portion 14 with side portions 15,16 extending perpendicularly from the base portion 14 along a longitudinal plane of the base portion 14, parallel to each other to form a longitudinally extending cavity 17. Opposing return tabs (not shown) extend from the ends of the side portions 15,16, distal to the base portion 14, to define a longitudinally extending opening 19 to the cavity 17, for reasons that will become apparent hereinafter.

The base portion 14 of the guide track 11 is fixedly mounted to a lower surface 20 of the upper support member 10 by known means such that the longitudinally extending opening 19 to the cavity 17 extends along the longitudinal axis of the upper support member 10. The door mounting 12 comprises a sliding trolley mechanism (not shown) and a door hanging mounting 22. The sliding trolley mechanism (not shown) is conventional and so no further discussion of it will be given in this specification.

The end panel 7 is a beam, wherein a longitudinally extending recess 25 is formed therein to extend along one side. The end panel 7 is fixedly mounted relative to one end of the upper support member 10 and extends vertically downwards therefrom.

The sole plate 5 has a substantially C-shaped cross-section and comprises a plate base 26 and flange portions 27,28 extending perpendicularly therefrom, parallel to each other. The sole plate 5 is disposed parallel to the upper support arrangement 4. First and second side panels 8*a*, 8*b* are shown in FIG. 3 and each side panel 8*a*,8*b* extends from the sole plate 5 to the upper support arrangement 4. The first and second side panels 8*a*, 8*b* oppose each other and extend parallel to each other. Each side panel 8*a*, 8*b* is fixedly attached to a corresponding inner surface 29,30 of the respective flange portions 27, 28 of the sole plate 5, and fixedly attached to a corresponding outer surface 31,32 of the upper support member 10 such that a space is defined between the first and second side panels 8*a*,8*b* for the sliding door 3 to be disposed therein.

Although in this embodiment a pair of first and second side panels 8*a*,8*b* are shown opposing each other, it will be understood that only a single side panel 8*a* may be used.

An end support 6 extends along one edge of each first and second end panel 8*a*,8*b* between the upper support member 10 and the sole plate 5 and is fixedly mounted thereto by known means. In this embodiment the first and second side panels 8*a*,8*b* extend substantially along the length of the sole plate 5. The upper support member 10 and guide track 11 extend further than the sole plate 5 from the edge of the side panels 8*a*,8*b* to which the end support 6 is mounted and the end panel 7 extends from the corresponding end of the upper support member 10. The upper support arrangement 4, pair of end supports 6 and the end panel 7 therefore define a doorway. Further, the pair of end supports 7 define an opening to the space between the side panels 8*a*,8*b*.

Although in this embodiment the sole plate 5 does not extend between the end panel 7 and the side panels 8*a*,8*b*, in another embodiment it may do so.

The end stop 13 is formed from a resilient material and is mounted to the upper support member 10 proximate to the end panel 7 at the end of the guide track 11 such that the door hanging mounting 22 impacts thereupon.

Figure 4:
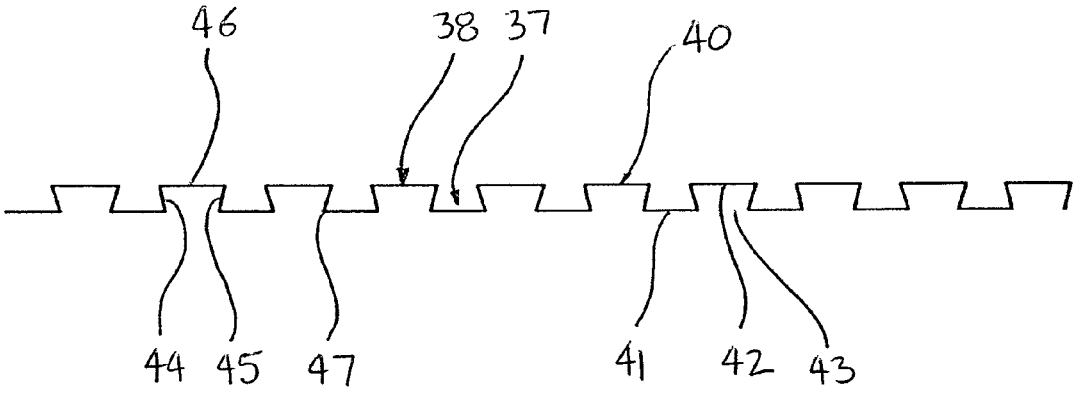
FIG. 4 is a cross-sectional view of a side panel of the support frame for a sliding door as shown in FIG. 1 in accordance with an exemplary embodiment of the present invention.
Figure 5:
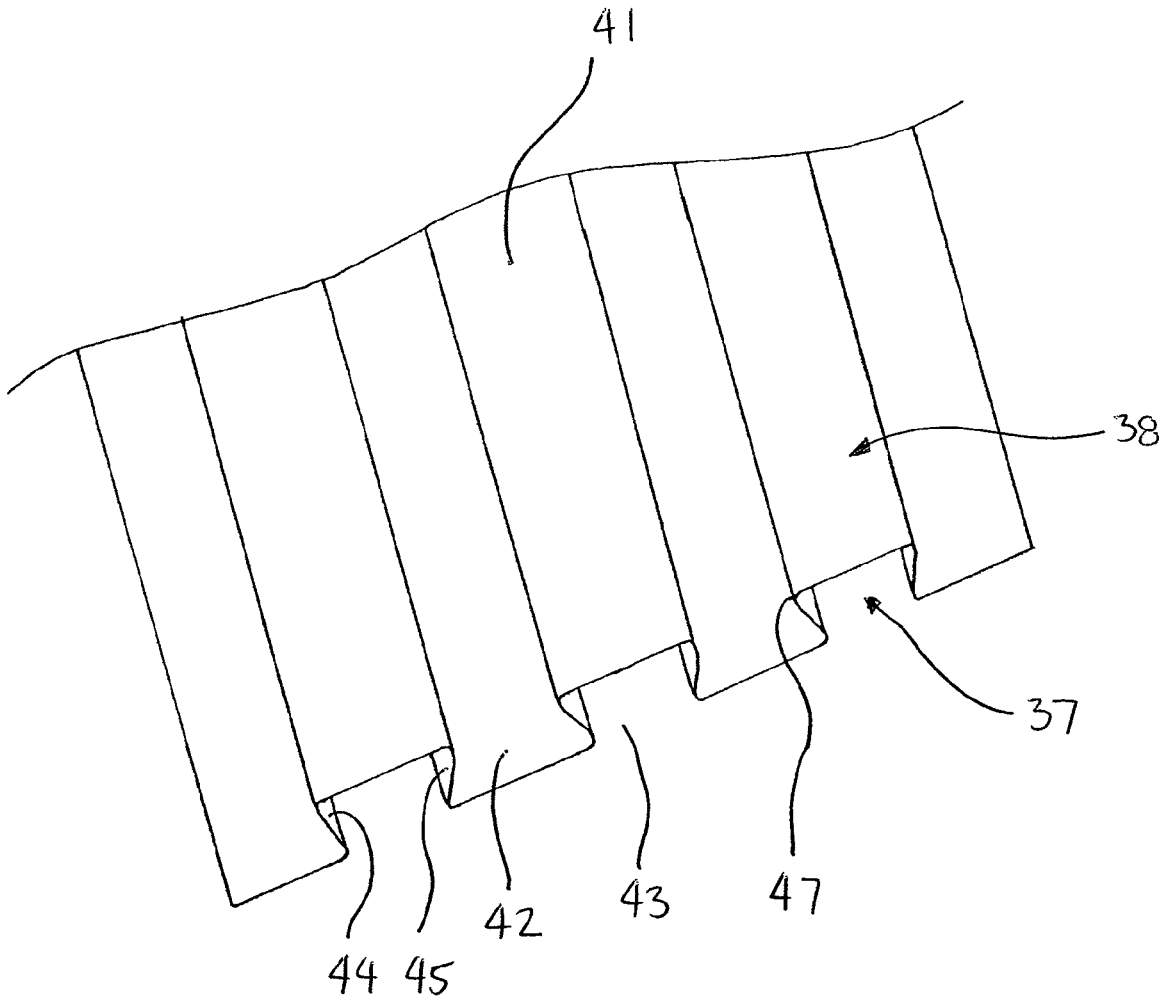
FIG. 5 is a perspective view of the side panel as shown in FIG. 4.
Figure 6:
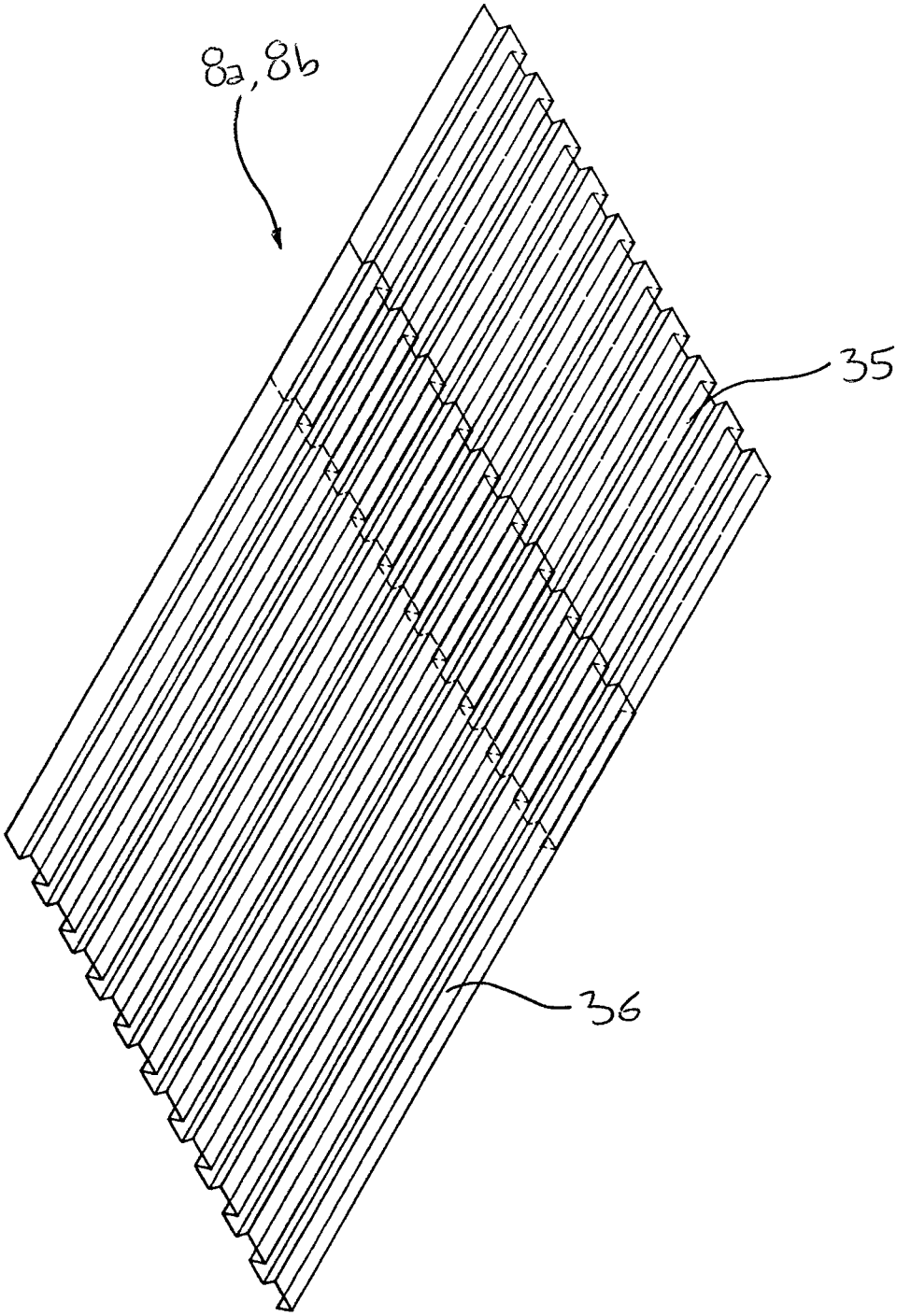
FIG. 6 is a perspective view of a pair of interlocking side panels as shown in FIG. 5.

Referring to FIG. 6, the side panels 8*a*,8*b* each comprise first and second panel portions 35,36. Each panel portion 35,36 is formed from a rigid corrugated sheet, such as sheet steel, and extends along a plane to define a panel. The cross sectional shape of each panel portion 35,36 is shown in FIGS. 4 and 5. The cross-sectional shape of each panel portion 35,36 forms a number of alternating elongate channels 37 and elongate ridges 38 on each face 40,41 of the panel portion 35,36, which extend parallel to each other along the panel portion 35,36.

Each channel 37 formed in a face 40,41 of each panel portion 35,36 includes a base 42, a mouth 43, and opposing side walls 44,45 that taper from the base 42 towards the mouth 43 so that the width of the mouth 43 extending between the side walls 44,45 is less than the width of the base 42 extending between the side walls 44,45, for reasons that will become apparent hereinafter. Each ridge 38 is formed between adjacent channels 37 and is formed by an outer surface 46 extending between ends 47 of opposing side walls 44,45 of each channel 37 such that each ridge 38 is defined by the outer surface 46 and opposing side walls 44,45 which taper from the base 42 of the channel 37 to the mouth 43 such that the width of the base 42 of each channel 37 is substantially the same as the width of the outer surface 46 of each ridge 38.

The alternating ridges 38 and channels 37 formed in a first face 40 of each panel portion 35,36 form corresponding alternating elongate channels 37 and ridges 38 respectively on the opposing second face 41 of the panel portion 35,36, wherein a ridge 38 formed on the first face 40 of the panel portion 35,36 defines a channel 37 on the opposing second face 41 of the panel portion 35,36, and a channel 37 formed on the first face 40 of the panel portion 35,36 defines a ridge 38 on the opposing second face 41 of the panel portion 35,36 With such a panel portion 35,36 with the above described cross sectional shape, each elongate ridge 38 defines a tenon which corresponds to a dovetail of the channel 37. Such a panel as described above is inherently very strong and has a low deflection along its length.

The elongate ridges 38 of the first panel portion 35 are slidable in the elongate channels 37 of the second panel portion 36, as shown in FIG. 6, such that the base 42 of each channel 37 is locatable relative to the outer surface 46 of each respective elongate ridge 38 of the opposing panel portion 35,36 and the side walls 44,45 of the first panel portion 35 are relative to the side walls 44,45 of the second panel portion 36 and subtend thereagainst such that the first and second panel portions 35,36 are located against each other and cannot be drawn away from each other in a direction perpendicular to the longitudinal axis of the elongate channels 37 and ridges 38.

One advantage of the support frame 2 described above is that the first and second panel portions 35,36 cannot deflect relative to each other because if a force is applied to a side of the panel portions 35,36 then the opposing side walls 44,45 of the channel 37 and ridge 38 act against each other and therefore are held rigidly thereagainst. The panel portions 35,36 therefore interlock with each other. This reduces the number of locking bolts (not shown), for example, that are required to prevent movement of the panel portions relative to each other as will become apparent below.

Corresponding holes (not shown) are formed through each of the first and second panel portions 35,36 at regular intervals therealong such that they can be aligned with each other dependent on the desired height of the side panel 8*a*,8*b*. Alternatively, the panel portions 35,36 are set to the desired position and a drill may be used to drill through the panel portions 35,36 to form aligned holes. Locking bolts (not shown) are disposed through the aligned holes to mount respective panel portions 35,36 to each other. In this embodiment the locking bolts comprise a flat headed portion with a threaded shank extending therefrom. The threaded shank is disposed through respectively aligned holes formed in both the first and second plate portions and a locking nut is threadingly engaged thereon. In this embodiment a pair of locking bolts are used, although the invention is not limited thereto. One advantage of utilising locking bolts is that they can be removed if the support frame 2 is to be disassembled, or the height of the door 3 adjusted.

Although the use of locking bolts and corresponding holes is described above, it will be understood that the invention is not limited thereto. In an alternative embodiment, it will be understood that the first and second plate portions may be fixedly mounted together by means of any suitable fixing means, for example, welding, rivets or a clamp.

Although in the above illustrated embodiment the side panels 8 have a particular cross sectional shape, it will be understood that the invention is not limited thereto and that the panel may form an alternative corrugated shape, for example, an arcuate wave-form shaped cross-section.

Assembly of the support frame 2 for the sliding door 3 will now be discussed with reference to FIGS. 1, 3 and 6.

The upper support arrangement 4 is mounted to a required upper surface, such as a beam, and the sole plate 5 is mounted to a respective lower surface by known means. The upper support arrangement 4 and sole plate 5 are disposed parallel to each other. The elongate ridges 38 are slid into the channels 27 of the first and second panel portions 35,36 such that the first and second panel portions 35,36 are interlocked with each other to form a panel 8*a*. The first and second panel portions 35,36 are slid with respect to each other to set the height of the panel and are then fixedly mounted to each other as described above. The corresponding second panel 8*b* is then formed to the same height by adjusting corresponding first and second panel portions 35,36 thereof.

Each panel 8*a*,8*b* is then mounted at one end to the respective inner surface 29,30 of the flange of the sole plate 5, and to the outer surface 31 of the upper support arrangement 4 such that they are securely mounted thereto.

The sliding trolley mechanism (not shown) is received through the opening 19 of the guide track 11 such that it is supported by the opposing return tabs (not shown) of the guide track 11 and is slidable therealong, to abut against the end stop 13. The end panel 7 is mounted to a distal end of the upper support member and is disposed to define one side of a doorway. Similarly, the pair of end supports 6 are fixedly mounted to opposing edges of the side panels 8*a*,8*b*, to define an opposing side of the doorway, and to define an opening to the cavity defined by the side panels 8*a*,8*b*, the upper support member 10 and the sole plate 5.

A door 3 is mounted at an upper end to the door hanging mounting 22 by known means, such that it is slidable with the door mounting when the sliding trolley mechanism (not shown) slides in the guide track 11. Herein, the door 3 is slidable through the opening defined by the pair of end supports 8 between an open position and a closed position. The door 3 is guided by the end supports 6 and is received in the recess 25 formed in the end panel 7 when the door 3 is closed.

Figure 7:
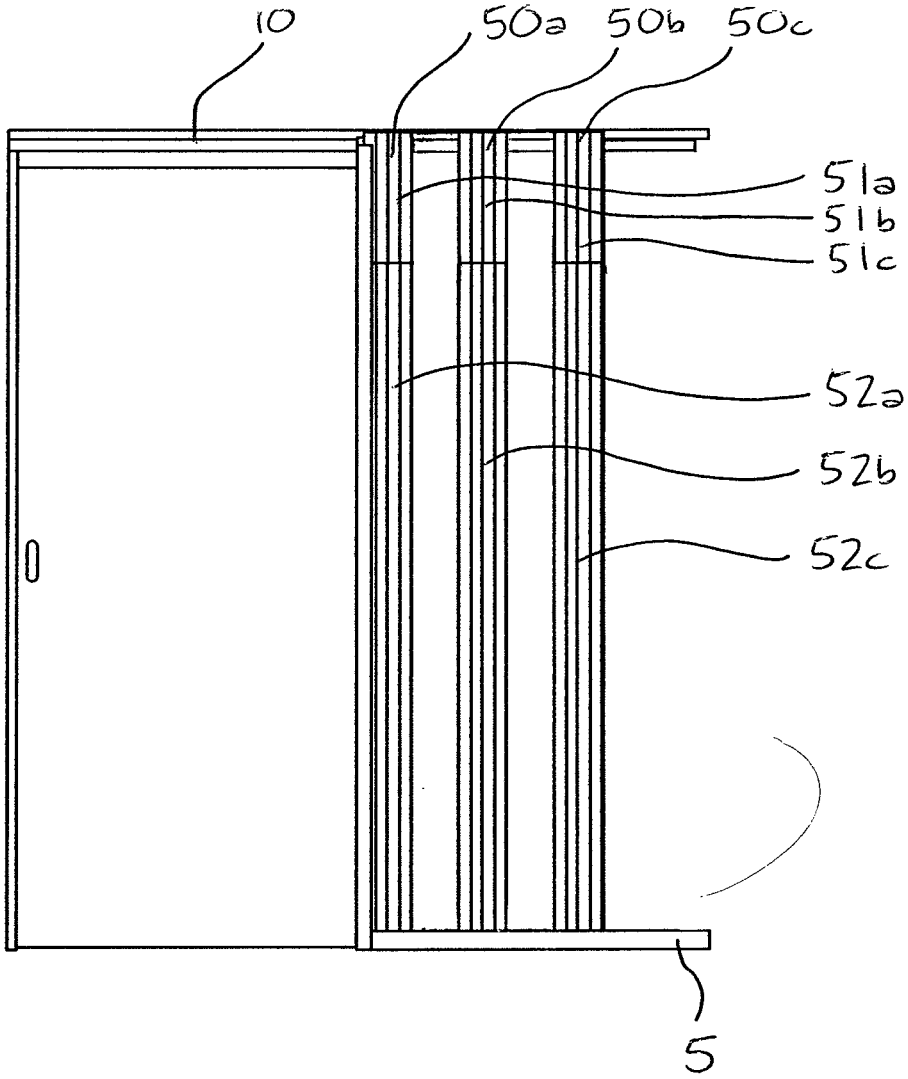
FIG. 7 is a side view of a support frame for a sliding door in accordance with another exemplary embodiment of the present invention.

A further exemplary embodiment of the invention will now be described with reference to FIG. 7. The main features of this embodiment are generally the same as those described in the embodiment discussed above, and so no further description of them will be given here. However, in this embodiment the support frame 2 comprises a plurality of side panels 50*a*, 50*b*,50*c* mounted on each side of the sole plate 5 and upper support member 10. Each side panel 50*a*,50*b*,50*c* is formed from first 51*a*,51*b*,51*c* and second 52*a*,52*b*,52*c* panel portions. This embodiment has an advantage in that the width of the support frame 2 may be altered by varying the distance between adjacent side panels 50*a*,50*b*,50*c*.

Figure 8:
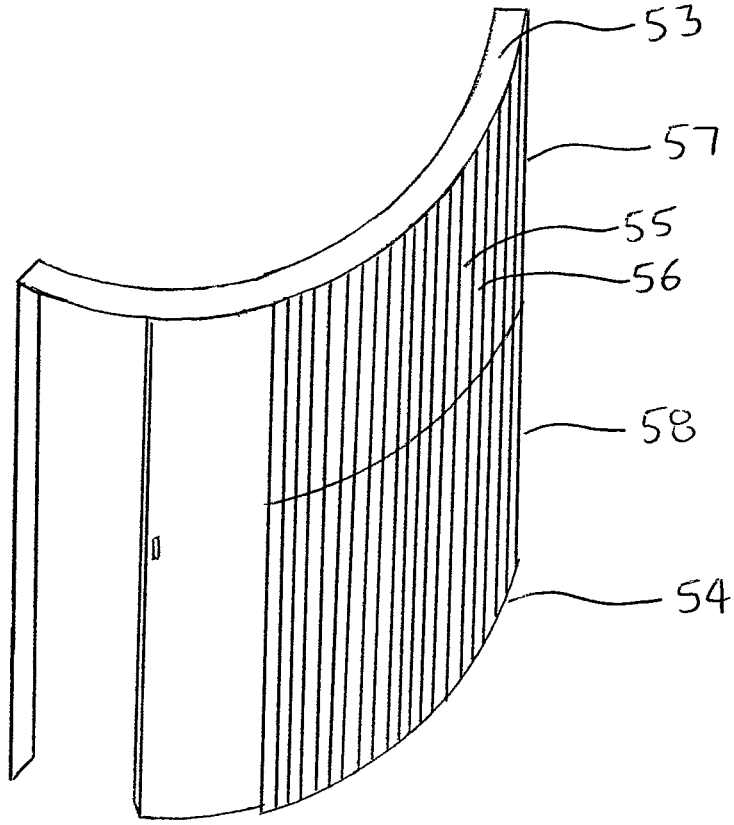
FIG. 8 is a perspective view of a support frame for a sliding door in accordance with yet another exemplary embodiment of the present invention, showing a sliding door supported thereon.

A further exemplary embodiment of the invention will now be described with reference to FIG. 8. The main features of this embodiment are generally the same as those described in the embodiment discussed above, and so no further description of them will be given here.

One advantage of the side panels 8*a*,8*b* discussed above is that, although they are substantially rigid and have a low deflection along their length defined by the elongate channel, they are relatively flexible in a perpendicular direction thereto. The present embodiment comprises an arcuate upper support arrangement 53 and an arcuate sole plate 54. Side panels are deformed about an axis parallel to the elongate channels 55 and ridges 56 such that a first panel portion 57 of the side panel 8*a*,8*b* is fixedly mounted to the arcuate upper support member 53 along one edge and a second panel portion 58 is fixedly mounted to the arcuate sole plate 54 along one edge. Such a support frame means that an arcuate sliding door may be utilised.

Although the exemplary embodiments discussed above describe doors formed in vertical walls, it will be understood that the invention is not limited thereto and may be utilised in horizontal surfaces, such as floors or ceilings.

Although embodiments of the invention have been shown and described, it will be appreciated by those skilled in the art that these are preferred embodiments only and that changes may be made to these embodiments, or alternative embodiments are included, within the scope of the invention which is defined in the claims hereafter.

The invention claimed is:

1. A sliding door assembly comprising a support frame and a sliding door, the support frame comprising upper and lower support frame members between which the sliding door is received, a side panel attachable so as to extend between said upper and lower support frame members, and a cavity defined between the upper support member, the lower support member and the side panel into which the sliding door is at least partially slidable to move into an open position, wherein the side panel comprises a first panel portion and a second panel portion that slide relative to each other and overlap to enable the distance between the upper and lower support frame members to be altered during installation of the support frame, wherein the panel portions have corrugations configured such that, when the panel portions overlap, the corrugations interlock to prevent movement of the panels relative to each other, other than sliding in a direction extending along the length of the corrugations, wherein the corrugations form a tenon and a corresponding mortise such that the corrugations on opposing panel portions interlock to form a dovetail joint, wherein the corrugations on each panel portion form a plurality of tenons and mortises to interlock with a plurality of tenons and mortises formed on the opposing panel portion.

2. The sliding door assembly according to claim 1, wherein the corrugations comprise a channel formed in the first portion of the side panel and a corresponding elongate ridge formed in the second portion of the side panel which is receivable in the channel such that the elongate ridge slides in the channel.

3. The sliding door assembly according to claim 2, wherein the elongate ridge comprises a pair of side walls to locate in the channel, substantially parallel to a pair of side walls of the channel.

4. The sliding door assembly according to claim 3, wherein the elongate ridge interlocks with the channel, such that the first and second portions of the side panel are slidable relative to each other along a first direction only, but cannot be drawn away from each other in a second direction perpendicular to the first direction.

5. The sliding door assembly according to claim 1, wherein the support frame further comprises a pair of side panels attachable on opposing sides of said upper and lower support frame members so as to extend on either side of a sliding door between said upper and lower support frame members.

6. The sliding door assembly according to claim 1, wherein the first panel portion is attachable to the upper support frame member and the second panel portion is attachable to the lower support frame member.

7. The sliding door assembly according to claim 1, wherein the upper support frame member is configured to be mounted to an upper support surface, and the lower support frame member is configured to be mounted to a lower support surface.

8. The sliding door assembly according to claim 1, wherein the upper support frame member is an uppermost support frame member of the support frame and the lower support frame member is the lowermost support frame member of the support frame.

9. A sliding door assembly comprising a support frame and a sliding door, the support frame comprising upper and lower support frame members between which the sliding door is received, a side panel attachable so as to extend between said upper and lower support frame members, and a cavity defined between the upper support member, the lower support member and the side panel into which the sliding door is at least partially slidable to move into an open position, wherein the side panel comprises a first panel portion and a second panel portion that slide relative to each other and overlap to enable the distance between the upper and lower support frame members to be altered during installation of the support frame, wherein the panel portions have corrugations configured such that, when the panel portions overlap, the corrugations interlock to prevent movement of the panels relative to each other, other than sliding in a direction extending along the length of the corrugations, wherein the corrugations comprise a channel formed in the first portion of the side panel and a corresponding elongate ridge formed in the second portion of the side panel which is receivable in the channel such that the elongate ridge slides in the channel, wherein the elongate ridge comprises a pair of side walls to locate in the channel, substantially parallel to a pair of side walls of the channel, wherein the side walls of the channel converge towards a mouth of the channel and the side walls of the elongate ridge are correspondingly angled.

10. The sliding door assembly according to claim 9, wherein the elongate ridge is wedge-shaped for mounting in a correspondingly wedge-shaped channel so that a portion of the wedge-shaped elongate ridge dovetails with the channel and is slidable therein.

11. A sliding door assembly comprising a support frame and a sliding door, the support frame comprising upper and lower support frame members between which the sliding door is received, a side panel attachable so as to extend between said upper and lower support frame members, and a cavity defined between the upper support member, the lower support member and the side panel into which the sliding door is at least partially slidable to move into an open position, wherein the side panel comprises a first panel portion and a second panel portion that slide relative to each other and overlap to enable the distance between the upper and lower support frame members to be altered during installation of the support frame, wherein the panel portions have corrugations configured such that, when the panel portions overlap, the corrugations interlock to prevent movement of the panels relative to each other, other than sliding in a direction extending along the length of the corrugations, wherein the support frame further comprises a channel formed in the second portion of the side panel and a corresponding elongate ridge formed in the first portion, wherein one side wall of the channel forms the side wall of an adjacent elongate ridge formed in each portion of the side panel, wherein the support frame further comprises a plurality of alternating channels and elongate ridges formed in the first and second channels, each elongate ridge corresponding with a respective channel in the opposing portion of the side panel, wherein each elongate ridge is defined by adjacent channels in a side panel.

12. The sliding door assembly according to claim 11, wherein the upper and lower support frame members are arcuately shaped and the first and second portions of the side panel are deformable to be fixedly mountable along the upper and lower support frame members respectively.

13. The sliding door assembly according to claim 11, wherein the support frame further comprises a plurality of corresponding first and second support portions fixedly mountable to the upper and lower support frame members respectively.

* * * * *